United States Patent [19]

Carr

[11] Patent Number: 4,763,900

[45] Date of Patent: Aug. 16, 1988

[54] BASEBALL BAT AND BALL/BAT COMBINATION

[76] Inventor: Ian Carr, 220 E. Walton Pl., Apt. 3E, Chicago, Ill. 60611

[21] Appl. No.: 865,843

[22] Filed: May 22, 1986

[51] Int. Cl.[4] ..... A63B 69/00; A63B 59/06; A63B 37/14; A63B 37/00

[52] U.S. Cl. ..... 273/26 R; 273/26 B; 273/72 R; 273/28; 273/58 K; 273/60 R

[58] Field of Search ..... 273/173, 174, 175, 167 J, 273/183 D, 186 A, 26 R, 26 B, 72, 28, DIG. 31, 67 R, 72 A

[56] References Cited

U.S. PATENT DOCUMENTS

| | | | |
|---|---|---|---|
| 716,541 | 12/1902 | Hillerich | 273/72 |
| 771,247 | 10/1904 | Hillerich | 273/72 |
| 805,132 | 11/1905 | Gubbins | 273/72 R |
| 838,257 | 12/1906 | Kinst | 273/72 |
| 1,530,427 | 3/1925 | Simon | 273/67 R |
| 3,869,126 | 3/1975 | Thompson | 273/167 J |
| 3,944,225 | 3/1976 | Greaney | 273/26 B |
| 4,438,924 | 3/1984 | Carr | 273/58 K X |
| 4,600,193 | 7/1986 | Merritt | 273/72 A |

FOREIGN PATENT DOCUMENTS

| | | | |
|---|---|---|---|
| 4301 | of 1912 | United Kingdom | 273/167 J |

*Primary Examiner*—Randolph A. Reese
*Assistant Examiner*—John A. Ricci
*Attorney, Agent, or Firm*—Lee & Smith

[57] ABSTRACT

A baseball bat for striking a spherical or spheroidal projectile having strike surface roughening characteristics in the nature of macroscopic grooves and superimposed microscopic roughening which are adapted to enhance the tendency of the projectile to spin when struck off-center or struck a glancing blow by the bat. The promotion of such tendency to spin enhances the tendency of the trajectory of the ball, after being so struck, to deviate from the trajectory that would be expected if the tendency of the projectile to spin were not thus enhanced. Utilization of the bat with a ball having similar surface roughening characteristics further enhances the deviating nature of the trajectory of the struck ball.

8 Claims, 2 Drawing Sheets

BASEBALL BAT AND BALL/BAT COMBINATION

BACKGROUND OF THE INVENTION

This invention relates to bats such as baseball bats and the like, including toy bats having improved strike surface properties. This invention also relates to a combination of such bats with balls having similar surface properties. More specifically, this invention relates to bats having selected strike surface roughening characteristics which promote the tendency of a ball to spin when struck off-center or struck a glancing blow by the bat. The promotion of such tendency to spin enhances the tendency of the trajectory of the ball, after being so struck, to deviate from the trajectory that would be expected if the tendency of the ball to spin were not thus enhanced. Incorporating such surface properties into the ball enhances the effect created by the bat.

Much effort has been directed in the past to improving bats, such as baseball bats, so that batsmen are less likely to hit foul and more likely to hit fair and safe. Examples of bats developed for such purposes are set forth in U.S. Pat. Nos. 1,530,427; 838,257; 805,132; and 771,247. Unless the leading edge of the bat strikes the ball and, preferably, is perpendicular to the flight path of the ball, the blow will, in some degree, be a glancing blow which, in turn, tends both to make the ball rebound off the bat at an angle and to make the ball spin. Such spin is greater the greater the friction between the bat surface and the ball surface and is less the less the friction between the bat surface and the ball surface. Spin brings into play forces, such as the Magnus and anti-Magnus forces described at length in my U.S. Pat. No. 4,438,924, which cause the trajectory of the ball to deviate from the trajectory expected if the ball were not spinning or were spinning at a different speed of rotation, spinning on a different axis of rotation, or both.

The batter often knows that he has not hit with the leading edge of the bat or not hit perpendicular to the flight path of the ball by both the initial direction of rebound off the bat and the effect on the flight path of the spin that the ball then possesses. The greater the spin of the ball, the greater the chances that the batter will be aware of so striking the ball because of the resulting pronounced deviation from the expected trajectory of the ball.

SUMMARY OF THE INVENTION

This invention promotes spin, when the bat strikes the ball, by roughening the strike surface of the bat. Intersecting grooves, such roughness elements being visible to the naked eye (termed throughout this application "macroscopic" grooves or elements), upon which is superimposed a very fine degree of roughness, such roughness elements being invisible to the naked eye (termed throughout this application "microscopic" elements), create appropriate degrees of roughening. By promoting spin and thereby promoting deviations in the flight path of the ball after it has been struck by the bat, such roughening both makes it more apparent that the ball has been struck a glancing blow, which is useful to batters and their coaches in the analysis and improvement of batting skills, and makes it more difficult for fielders to field the ball, which is useful to fielders and their coaches in the analysis and improvement of fielding skills. In addition, the unexpected flight trajectories after the ball has left the bat are sheer fun to watch both as a spectator and as a participant.

Not only may the bat be so constituted, but also the ball may be similarly constituted, as described in great detail in my U.S. Pat. No. 4,438,924, the disclosure of which is incorporated herein by reference. The roughness of the bat intersects with the roughness of the ball to greatly increase the spin and therefore the spin forces, such as the Magnus and anti-Magnus forces, which enhance the deviation of the trajectory of the ball from that typically expected.

BRIEF DESCRIPTION OF THE DRAWINGS

The invention is described in greater detail in the following description of examples embodying the best mode of the invention, taken in conjunction with the drawings, in which.

DESCRIPTION OF EXAMPLES EMBODYING THE BEST MODE OF THE INVENTION

Figure 1:
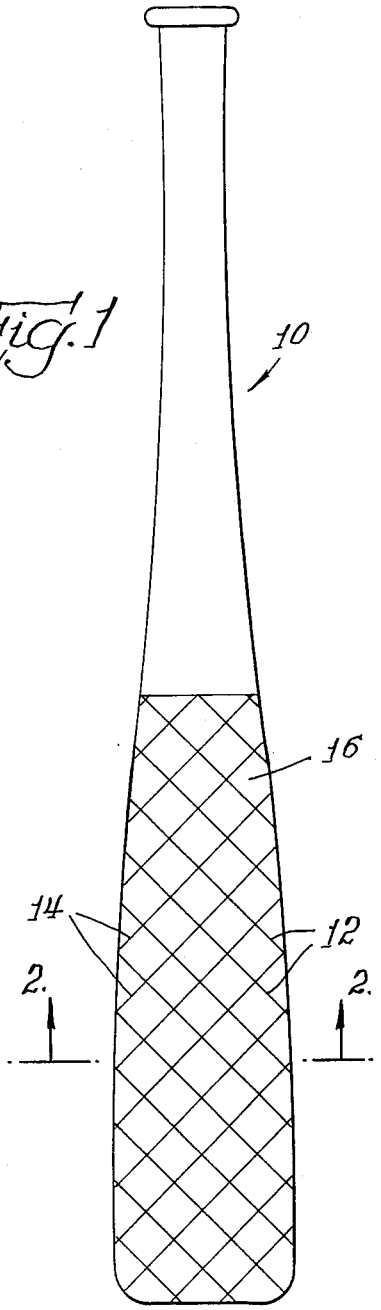
FIG. 1 is an elevational view of a bat according to the invention with the spacing between the intersecting grooves being greatly exaggerated.

A bat 10 according to the invention is depicted in FIG. 1. The bat 10 is provided with a series of macroscopic intersecting grooves 12 and 14 which are formed at an angle of between 40° and 90° with respect to one another. Intersection of the grooves leaves roughness elements 16 remaining in the surface of the bat 10. The preferred range of roughness is between a "fine" degree of such roughness and a "coarse" degree of such roughness. A fine degree of roughness may be accomplished with the grooves 12 and 14 about 1/32 (0.03125) inches apart, about 0.01 inches wide, and about 0.01 inches deep. An intermediate degree of such roughness may be accomplished with the grooves 12 and 14 about 1/24 (0.04267) inches apart, about 1/64 (0.015625) inches wide and about 1/64 (0.015625) inches deep. A coarse degree of such roughness may be accomplished with the grooves 12 and 14 having a spacing, width and depth of about 1/16 (0.0625) inches.

Figure 3:
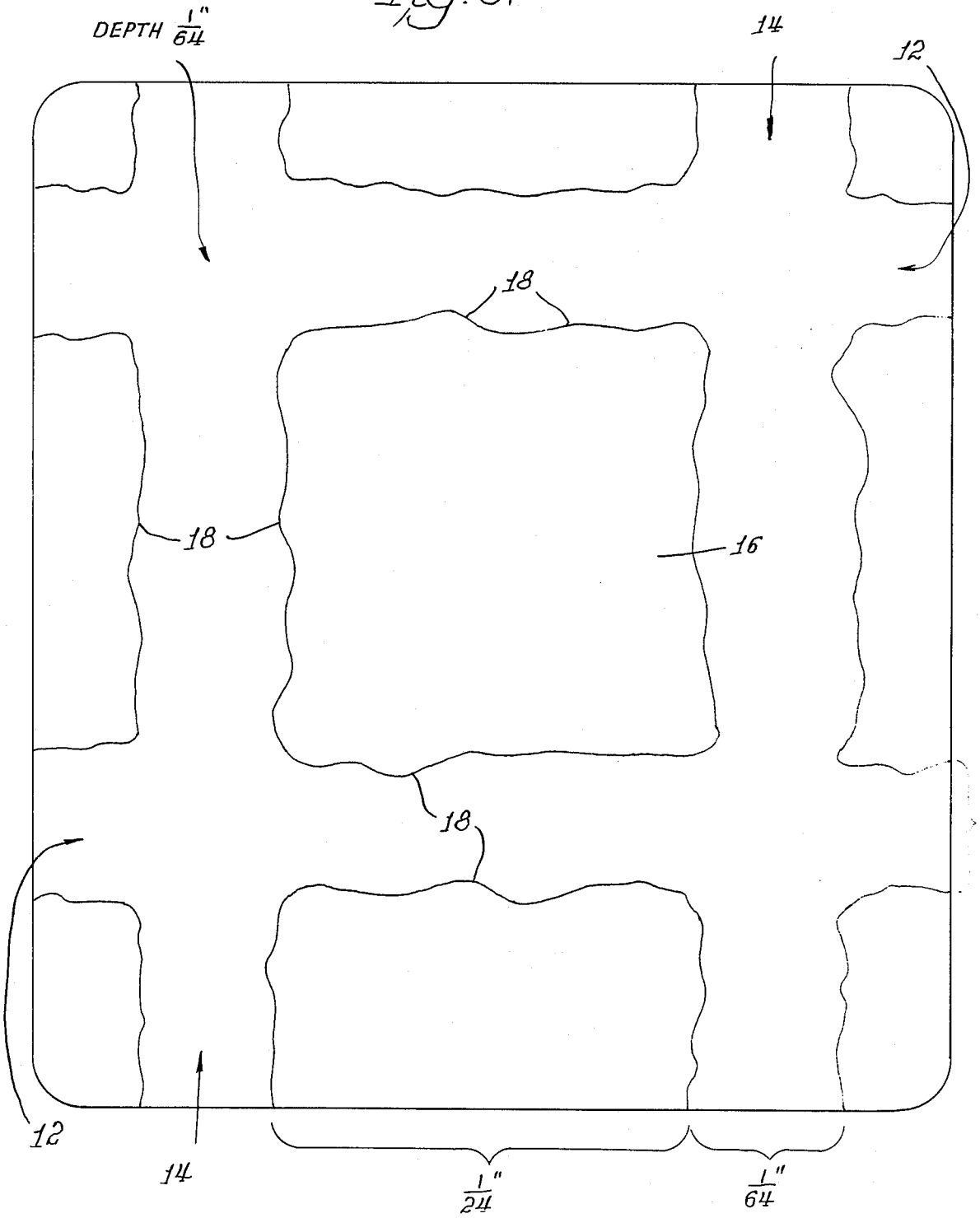
FIG. 3 is a representation of the surface of the bat, greatly magnified, to illustrate the appearance of the bat roughened with an intermediate degree of roughening.

The roughness elements 16 provided by the intersecting grooves 12 and 14 are visible to the naked eye, to which the appearance is as much one of evenly spaced stipples or elevations as it is one of intersecting grooves. Superimposed upon the grooves 12 and 14 are very finely textured microscopic roughenings 18 which are about 0.0025 inches apart, about 0.0025 inches wide, and about 0.0025 inches deep, and which are distributed in any pattern including a random pattern. The individual features of these very fine roughness elements are not visible to the naked eye, and are illustrated schematically only in FIG. 3.

Figure 5:
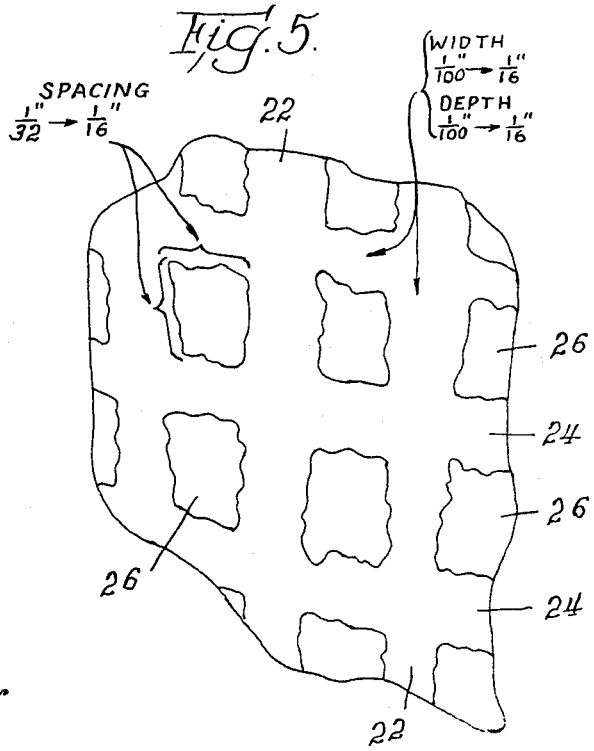
FIG. 5 is a greatly magnified view of a portion of the surface of the ball of FIG. 4 showing the nature of the aerodynamic roughening.
Figure 4:
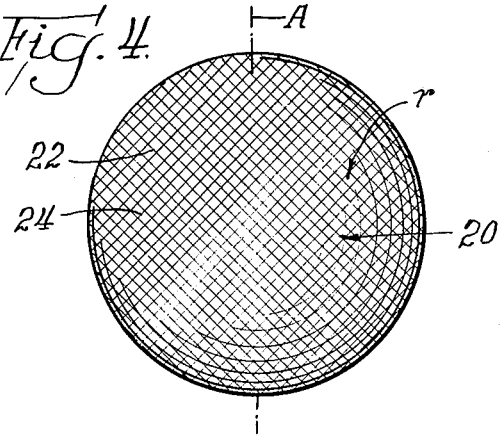
FIG. 4 is a plan view of a ball according to the invention having aerodynamic roughening distributed over its entire surface.

The aerodynamic roughness provided on a roughened ball 20 according to the invention is generally indicated in FIG. 4 by the reference "r". The roughness "r" causes parts of the surface of the ball to protrude through the laminar sublayer of the boundary layer, as described in detail in my referenced U.S. Pat. No. 4,438,924. The preferred range of roughness may be accomplished when the surface of the ball is provided with intersecting grooves 22 and 24 which are placed at an angle of between 40° and 90° with respect to each other. The spacing, depth and width of the grooves and degrees of roughness are indentical to those of the bat 10, described immediately above. The ball 20 may be solid or hollow, as desired, and the roughness "r" preferably is composed of stiff roughness elements 26, shown in greater detail in greatly magnified fashion in FIG. 5.

When the bat 10 with strike surface roughening as described above is used in conjunction with a roughened ball, particularly the ball 20, the tendency of the ball to spin when stuck off-center or stuck a glancing blow by the bat is enhanced and the tendency of the trajectory of the ball, after being so struck, to deviate from the trajectory that would be expected if the tendency of the ball were not thus enhanced, is also enhanced. This is because the roughenings on the strike surface of the bat 10 grip the surface of the ball and, if there are any roughening elements on the ball, engage or interlock with such roughening elements. Such gripping, engagement or interlocking between the strike surface of the bat 10 and the surface of the ball imparts spin to the ball.

Figure 2:
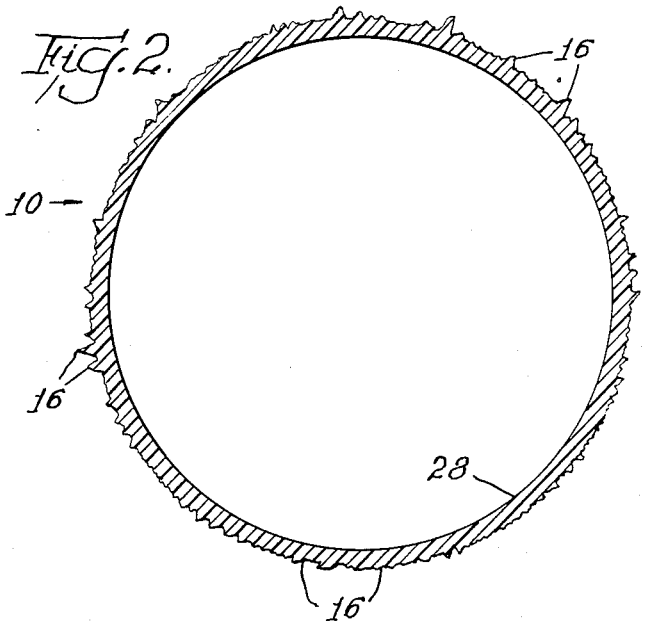
FIG. 2 is an enlarged cross-sectional illustration taken along lines 2—2 of FIG. 1 with the surface roughening elements being greatly exaggerated for purposes of illustration.

The bat 10 may be made of a plastic material, may have a hollow interior 28 (FIG. 2), and may be fabricated by the process of blow-molding. When a hollow article with a grooved or otherwise roughened surface is fabricated by blow-molding, there may be loss of the fidelity with which the finished surface of the molded product conforms to the engrave surface of the mold. This is because air may be trapped between the surface of the plastic and the corresponding surface of the mold. When the blow-molding process is used, the macroscopic roughness described above is engraved on the surface of the cavity of the mold before the microscopic roughness is engraved, and such microscopic roughness inhibits the trapping of air referred to above, by providing a plurality of microscopic channels for the escape of the air. The microscopic roughening therefore provides not only the advantage of enhanced friction between the bat 10 and the ball 20, but also the additional advantage of promoting fidelity in the reproduction of the macroscopic roughening of the mold cavity onto the surface of the finished product, the bat 10 or the ball 20.

Although the invention has been described above with a certain degree of particularity, it should be understood that the disclosure has been made only by way of example. Consequently, numerous changes in the details of construction and in the combination and arrangement of components, as well as in the possible modes of utilization in accordance with the invention would be apparent to those skilled in the art, and may be resorted to without departing from the spirit of the invention or scope of the following claims.

What is claimed is:

1. In combination, a bat and a spheriodal projectile for launching into ballistic flight by said bat, a. the bat comprising an elongated shaft having a strike surface with a surface roughness formed therein which comprises a plurality of macroscopic intersecting grooves, b. the projectile having a dense concentration of aerodynamic roughening elements per unit of surface area which protrude through the laminar sublayer of the fluid boundary layer flowing past the projectile in flight, said surface roughness and said aerodynamic roughening elements being substantially identical and said aerodynamic roughening being adapted to cause said projectile to experience asymmetric lateral drag forces which drive said projectile through a flight trajectory having a first curved flight direction followed by a second curved flight direction having a curve component opposite to said first curved flight direction, where the curved flight directions are related to the density of the aerodynamic roughening elements, such that when the spheroidal projectile is struck by a glancing blow by the bat the tendency of the projectile to spin after being so struck is enhanced by interengagement of said surface roughness of said bat and said aerodynamic roughening elements of said projectile.

2. The combination in accordance with claim 1 including a microscopic roughening superimposed upon said intersecting grooves.

3. The combination in accordance with claim 1 including a microscopic roughening superimposed upon said intersecting grooves.

4. The combination in accordance with claim 1 in which said aerodynamic roughening elements comprise a plurality of macroscopic intersecting grooves on said projectile, said grooves on said projectile being arranged to intersect at an angle of between 40° and 90°, and being spaced from about 0.03125 inches to about 0.0625 inches apart.

5. The combination in accordance with claim 1 which said aerodynamic roughening elements comprise a plurality of macroscopic intersecting grooves on said projectile, said grooves on said projectile having a width and depth in the range of between about 0.01 inches and about 0.0625 inches.

6. The combination in accordance with claim 1 in which said aerodynamic roughening elements comprise a plurality of macroscopic intersecting grooves, said grooves being arranged to intersect at an angle of between 40° and 90°, and being spaced from about 0.03125 inches to about 0.0625 inches apart.

7. The combination in accordance with claim 1 in which said aerodynamic roughening elements comprise a plurality of macroscopic intersecting grooves, said grooves having a width and depth in the range of between about 0.01 inches and 0.0625 inches.

8. The combination in accordance with claim 1 in which said grooves are arranged to intersect at an angle of between about 40° and 90° and are spaced about 0.03125 inches apart, and said grooves have a width and depth in the range of between about 0.01 inches and 0.0625 inches.

* * * * *